US008522857B2

(12) United States Patent
Goettsch et al.

(10) Patent No.: US 8,522,857 B2
(45) Date of Patent: Sep. 3, 2013

(54) LADLE FOR MOLTEN METAL

(75) Inventors: David D. Goettsch, Shelby Township, MI (US); Jason R. Traub, Sterling Heights, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 12 days.

(21) Appl. No.: 13/156,470

(22) Filed: Jun. 9, 2011

(65) Prior Publication Data

US 2012/0312493 A1 Dec. 13, 2012

(51) Int. Cl.
*B22D 35/04* (2006.01)
*B22D 41/04* (2006.01)

(52) U.S. Cl.
USPC ..... 164/136; 164/336

(58) Field of Classification Search
USPC ..... 164/136, 335, 336
See application file for complete search history.

(56) References Cited

U.S. PATENT DOCUMENTS

| | | | | |
|---|---|---|---|---|
| 3,556,354 | A * | 1/1971 | Ott | 222/629 |
| 5,704,413 | A * | 1/1998 | Takasaki et al. | 164/136 |
| 6,460,605 | B1 * | 10/2002 | Grolla | 164/335 |
| 2005/0023737 | A1 * | 2/2005 | Takahashi et al. | 266/217 |
| 2009/0301681 | A1 | 12/2009 | Goettsch | |

FOREIGN PATENT DOCUMENTS

JP 2-30366 A * 1/1990

* cited by examiner

*Primary Examiner* — Kevin P Kerns
(74) *Attorney, Agent, or Firm* — Fraser Clemens Martin & Miller LLC; J. Douglas Miller

(57) ABSTRACT

A ladle for a molten metal includes a main body having a hollow interior and an opening for receiving the molten metal. The main body has a sidewall with a nozzle formed therein. The nozzle defines an axis of rotation for the main body. The nozzle contacts, seals and is in fluid communication with the mold. The nozzle is configured to deliver the molten metal to a mold when the main body is rotated from a first position to a second position.

7 Claims, 8 Drawing Sheets

LADLE FOR MOLTEN METAL

FIELD OF THE INVENTION

This invention relates to a ladle and system for the transfer of a molten metal from the ladle to a casting mold.

BACKGROUND OF THE INVENTION

The pouring of a molten material, such as metal, for example, into a casting mold is a significant process variable that influences the internal soundness, surface conditions, and mechanical properties, such as tensile strength, porosity, percent elongation and hardness, of a cast object. Many different designs for dipping/pouring ladles exist and are used in the foundry industry. The designs are normally chosen based upon the type of molten metal and casting mold used. Commonly used ladles make use of a slot, a lip and a baffle, or a dam at the top of the ladle to reduce inclusion of furnace metal oxides during metal filling, or the ladle may incorporate a stopper rod to control the flow of metal into and out of the ladle.

Molten metals such as aluminum, for example, react with the air and create oxides, commonly known as dross, which upon mixing with the rest of the molten metal creates inclusions and highly porous regions in the cast object during solidification of the metal. While many factors influence and account for undesirable properties in the cast object, two common sources of inclusions include formation of a dross layer on top of the molten metal, and the folding action of the molten metal caused by turbulent flow of the molten metal during pouring. Turbulent metal flow exposes the molten metal surface area to the air which creates the dross layer. Depending on the velocity of the molten metal, dictated by the pouring ladle and basin design and use, the molten metal may fold-over itself many times, thereby trapping oxygen and metal oxide layers therein and exposing additional surface area of the metal to the air.

Typical foundry ladles are referred to as tilt-pour ladles. These ladles are substantially cylindrical in shape with an external spout extending outwardly from the top thereof. Certain tilt-pour ladles have incorporated a wall or a baffle to separate the bowl or cavity area of the ladle from the spout. The wall or baffle may extend to the bottom of the ladle. When the molten metal is poured, the baffle restricts the flow of molten metal from the top of the ladle to facilitate the pouring of the metal that is near the bottom of the ladle. The metal at the bottom of the ladle is substantially free from dross and other foreign material that may be present, such as eroded refractory lining and ash created during a melting process of the metal.

Although the baffle serves to minimize dross inclusion, the external spout design still increases the velocity of the material upon pouring, and may create turbulent flow. The molten metal is typically transferred from the ladle to a casting mold through the pour basin. Turbulence of the molten metal also results when the molten metal is poured through the air and into a pour basin. In traditional pour basin designs, molten metal flows down the basin to a mold sprue. The flow of the molten metal through the sprue may also cause turbulence therein, thereby creating additional dross.

There is a continuing need for a ladle and system for transferring a molten metal from the ladle to a casting mold to minimize turbulence in the molten metal and militate against inclusions in a cast object including sub-surface porosity formed by a tilt-pour molding process.

SUMMARY OF THE INVENTION

In concordance with the instant disclosure, a ladle and system for transferring a molten metal from the ladle to a casting mold to minimize turbulence in the molten metal and militate against inclusions including sub-surface porosity formed in a cast object formed by a tilt-pour molding process, has surprisingly been discovered.

In a particular embodiment, the ladle is a capped, horizontal cylinder with a top open face. The open face is used for filling from a dip well, as well as for metal flash removal. An off-center cylindrical nozzle is separate from the open face of the ladle. The nozzle defines an axis of ladle rotation. After ladle dip and sealing with the horizontal mold wall, the ladle is rotated to bring molten metal past a height of the nozzle. A funnel panel is used to direct a volume of the molten metal to the nozzle. The ladle eliminates a nozzle-to-basin metal drop associated with traditional tilt-pour ladles while maintaining an efficiency of being filled from a dip well. This is accomplished by a sealing of the ladle nozzle to a sprue mold wall. After the nozzle is sealed to the mold wall, the ladle is rotated to bring molten metal above the nozzle. At this point, the ladle functions as a filled basin. The ladle allows easy removal of remnant metal skin. It is also a direct substitute for traditional semi-permanent mold cylinder head ladles.

In one embodiment, a ladle for molten metal includes a main body having a hollow interior and an opening for receiving the molten metal. The main body has a sidewall with a nozzle formed therein. The nozzle defines an axis of rotation for the main body. The nozzle is configured to deliver the molten metal to a mold when the main body is rotated from a first position to a second position.

In another embodiment, a casting apparatus includes a ladle for molten metal. The ladle has a main body with a hollow interior and an opening for receiving the molten metal. The main body has a sidewall with a nozzle formed therein. The nozzle defines an axis of rotation for the main body and is configured to deliver the molten metal when the main body is rotated from a first position to a second position. The casting apparatus also includes a mold. The mold has an inlet and a cavity formed therein for receiving the molten metal. The nozzle of the ladle is in fluid communication with the inlet. The ladle is rotatable about the axis of rotation to deliver the molten metal from the nozzle of the ladle into the cavity of the mold when the ladle is rotated from the first position to the second position.

In a further embodiment, a method for transferring molten metal to a mold includes the steps of filling the ladle with the molten metal; placing the nozzle of the ladle in fluid communication with the inlet of the mold; and rotating the ladle from the first position to the second position to deliver the molten metal from the ladle into the cavity of the mold.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DETAILED DESCRIPTION OF THE EMBODIMENTS

The following detailed description and appended drawings describe and illustrate various exemplary embodiments of the invention. The description and drawings serve to enable one skilled in the art to make and use the invention, and are not intended to limit the scope of the invention in any manner. In respect of the methods disclosed, the steps presented are exemplary in nature, and thus, the order of the steps is not necessary or critical.

Figure 1:
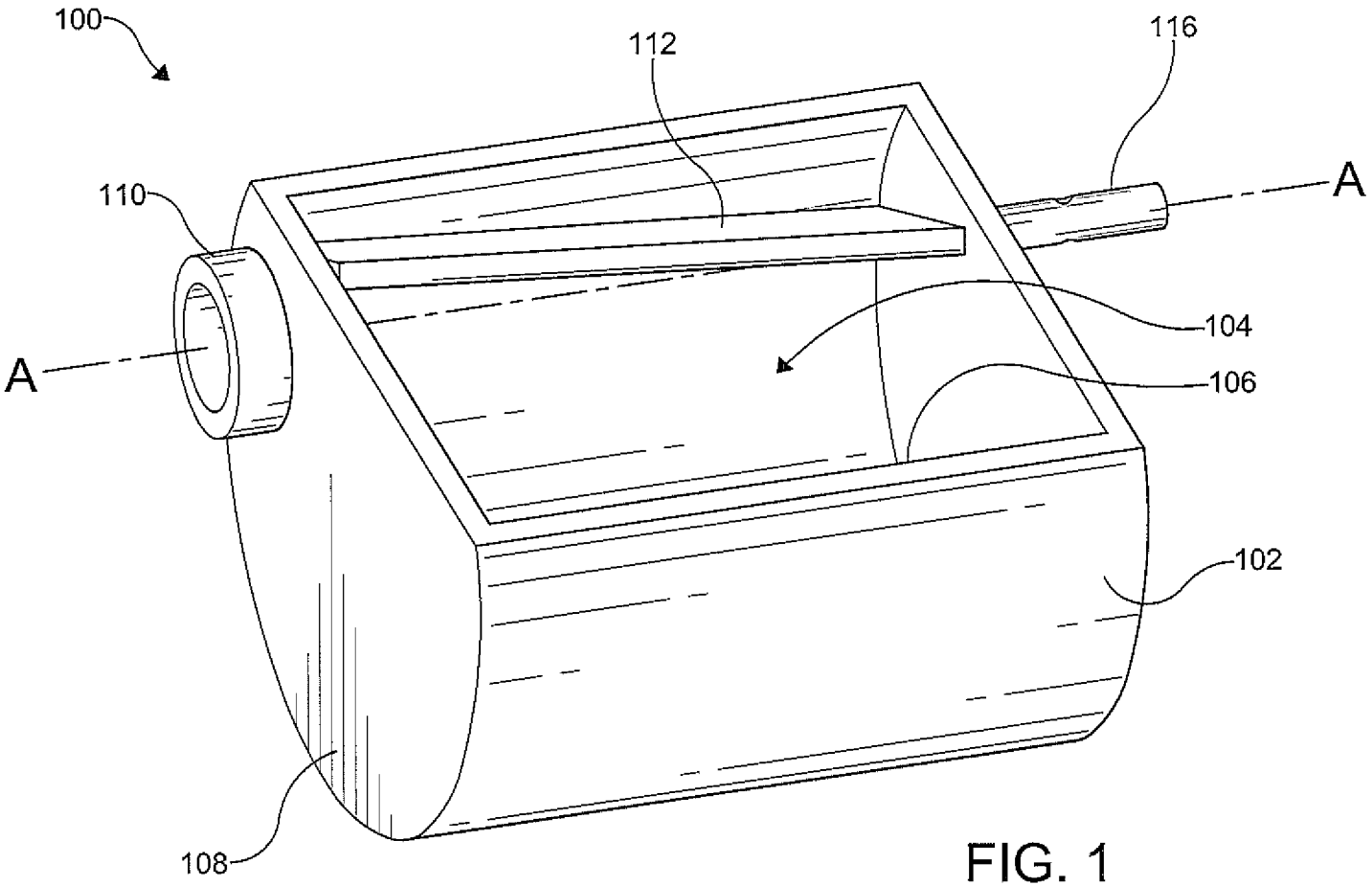
FIG. 1 is a perspective view of a ladle according to one embodiment of the present disclosure.

FIG. 1 shows a ladle 100 for molten metal 101 (shown in FIGS. 2A-3B) according to one embodiment of the disclosure. The ladle 100 includes a main body 102 having a hollow interior 104 and an opening 106 for receiving the molten metal 101. The opening 106 has a size that accommodates a dipping operation while permitting the ladle 100 to hold a sufficient quantity of the molten metal 101 in the hollow interior 104 during transport. For example, the opening 106 may be a substantially open top used for filling the hollow interior 104 with the molten metal 101. As a nonlimiting example, the main body 102 may be in the form of a partial cylinder with capped ends. Other shapes for the main body may also be used, as desired.

The main body 102 has a sidewall 108 with a nozzle 110 formed therein. The nozzle 110 may be integral with the sidewall 108 the main body 102, for example. The nozzle 110 is adapted to rotate together with the main body 102, for example, up to 360 degrees. The nozzle 110 defines an axis of rotation A for the main body 102. The axis of rotation A may substantially parallel with a longitudinal axis of the main body 102, for example. The nozzle 110 is configured to deliver the molten metal 101 when the main body 102 is rotated from a first position (shown in FIG. 3A) to a second position (shown in FIG. 3B).

In particular embodiments, the nozzle 110 is cylindrical and extends outwardly from the sidewall 108. In other embodiments, the nozzle 110 may be a hole formed in the sidewall 108. Other suitable shapes and configurations of the nozzle 110 are also within the scope of the present disclosure.

It should be understood that the axis of rotation A of the main body 102 is eccentric, that is, the nozzle 110 is offset from a center of the sidewall 108. The eccentric axis of rotation A permits the molten metal 101 in the hollow interior 104 to not be in fluid communication with the nozzle 110 when the main body 102 is in the first position. The eccentric axis of rotation A also permits the molten metal 101 of the hollow interior 104 to be in fluid communication with the nozzle 110 when the main body 102 is in the second position. The molten metal 101 is thereby delivered through the nozzle 110 of the main body 102 when the ladle 100 is rotated from the first position to the second position, in operation.

In a further embodiment, the ladle 100 may include a funnel panel 112. The funnel panel 112 is disposed in the hollow interior 104 of the main body 102. The funnel panel 112 directs the molten metal 101 toward the nozzle 110 when the ladle 100 is rotated to the second position during an operation of the ladle 100. For example, the funnel panel 112 may be oriented at an angle relative to the axis of rotation A of the main body 102. The funnel panel 112 speeds the delivery of the molten metal 101, for example, by allowing in combination with the nozzle 110 at least two inches of head pressure at the nozzle 110. Suitable angles for the funnel panel 112 may be selected by the skilled artisan, as desired.

Figure 7A:
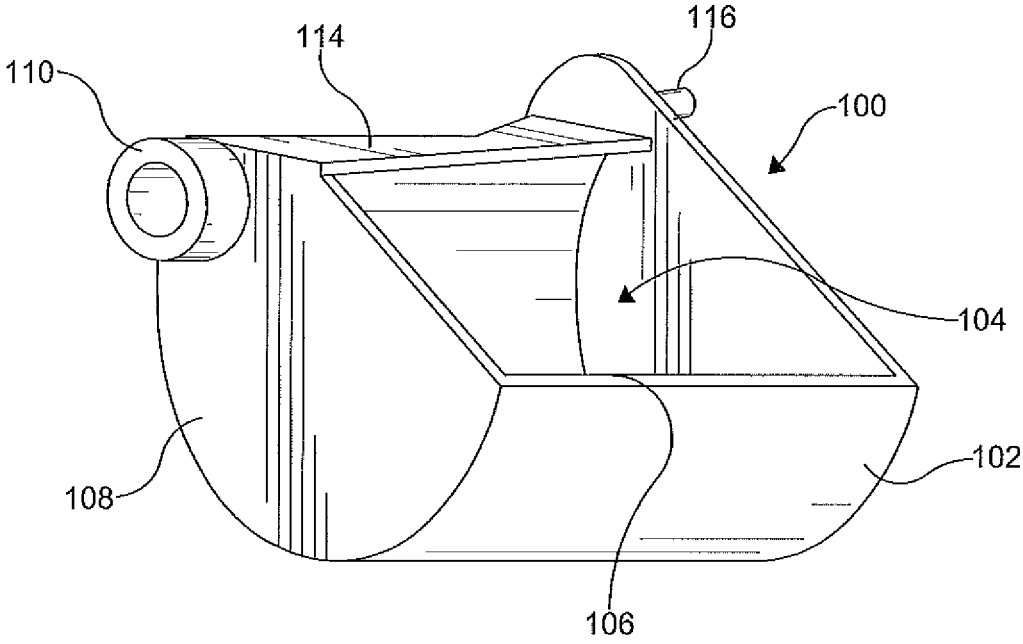
FIGS. 7A-7B are perspective views of a ladle according to an alternative embodiment of the present disclosure.
Figure 7B:
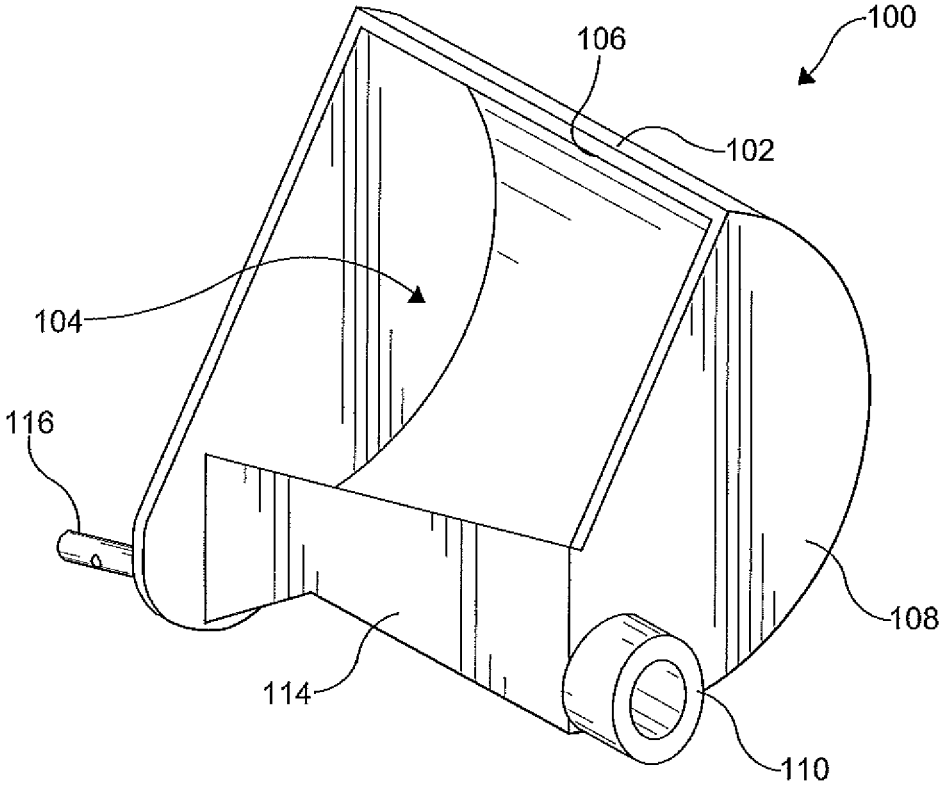

Referring now to FIGS. 7A and 7B, a ladle 100 according to an alternative embodiment of the disclosure is shown. The main body 102 of the ladle 100 may include the funnel panel 112 as a rear wall 114 of the main body 102 adjacent the nozzle 110. An orientation of the rear wall 114 may be such as the rear wall 114 is angled downwardly when the main body 102 is rotated to the second position. For example, the axis of rotation A defined by the nozzle 110, and with which the rear wall 114 may be oriented in parallel, may be offset from a longitudinal axis of the main body 102. The offset allows a side of the main body 102 opposite the nozzle 110 to lift up and angle a flow of the molten metal 101 to the nozzle 110 when the main body 102 is in the second position. As a nonlimiting example, the offset between the axis of rotation A and the longitudinal axis of the main body 102 may be about ten degrees (10°). Other suitable offsets may also be used, as desired. Like the funnel panel 112 described hereinabove, the angled rear wall 114 may thereby direct the molten metal 101 toward the nozzle 110 when the ladle 100 is rotated to the second position.

With renewed reference to FIG. 1, the ladle 100 of the present disclosure may be operated by equipment such as an actuator or robot (not shown). The equipment may rotate or otherwise pivot the main body 102 of the ladle 100 in each of a filling operation and a pouring operation. As a nonlimiting example, the ladle 100 may include a pin 116 formed on the main body 102 to facilitate the rotating of the main body 102 from the first position to the second position. The pin 116 may be disposed along the axis of rotation A of the main body 102, for example. In another embodiment, the equipment may be connected to the main body 102 with a bracket (not shown) or the like, to permit the transportation and rotation of the ladle 100. Other means for operating the ladle 100 between the first position and the second position may also be employed within the scope of the present disclosure.

Figure 2A:
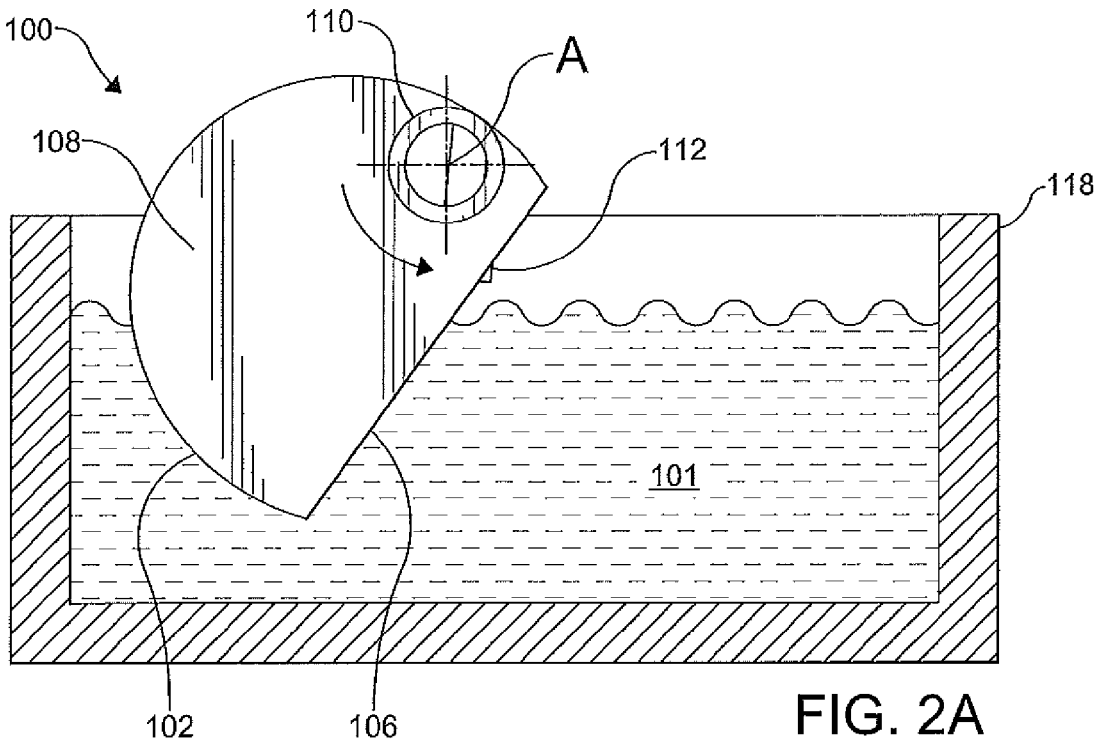
FIGS. 2A-2B are cross-sectional side elevational views of the ladle shown in FIG. 1, illustrating a filling of the ladle in a dip well.
Figure 2B:
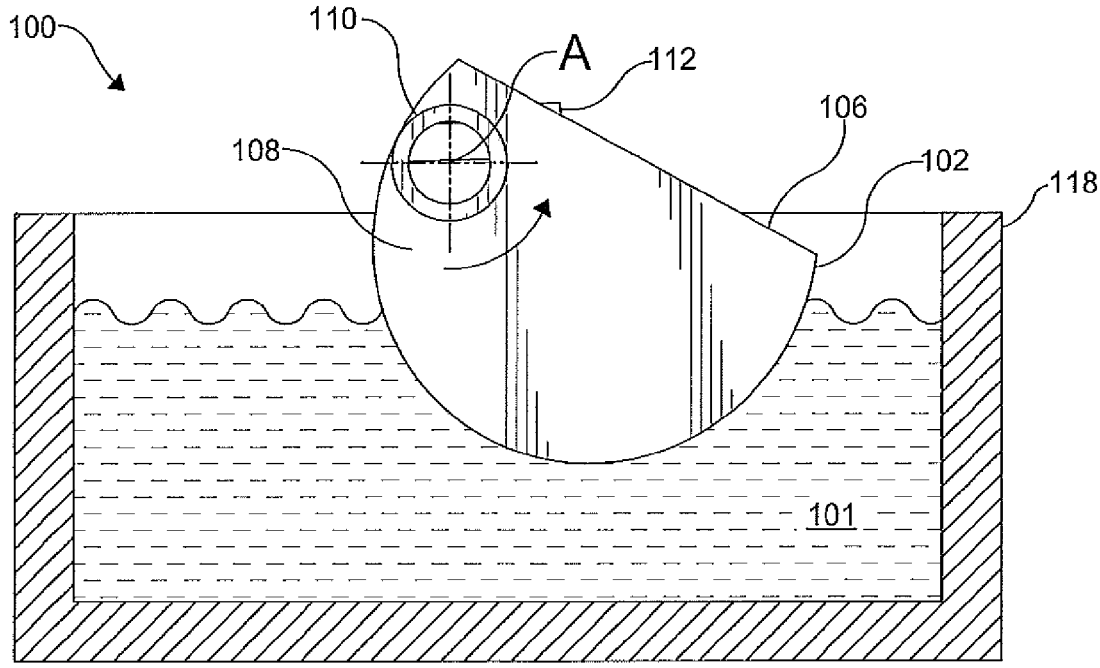

A filling operation with the ladle 100 is shown in FIGS. 2A-2B. The ladle 100 may be filled through use of a dip well 118 or the like. The ladle 100 may be inserted into the molten material 101 in the dip well 118 in a third position, as shown in FIG. 2A, for example. The nozzle 110 is not inserted under the molten material 101 when the ladle 100 is in the third position. As shown in FIG. 2B, the ladle 100 may then be rotated about the axis of rotation A to the first position. The nozzle 110 is also not inserted under the molten material 101 when the ladle 100 is in the first position. The ladle 100 is thereby filled for transport and a subsequent casting operation. One of ordinary skill in the art may select other suitable means for filling the ladle 100, as desired.

Figure 3A:
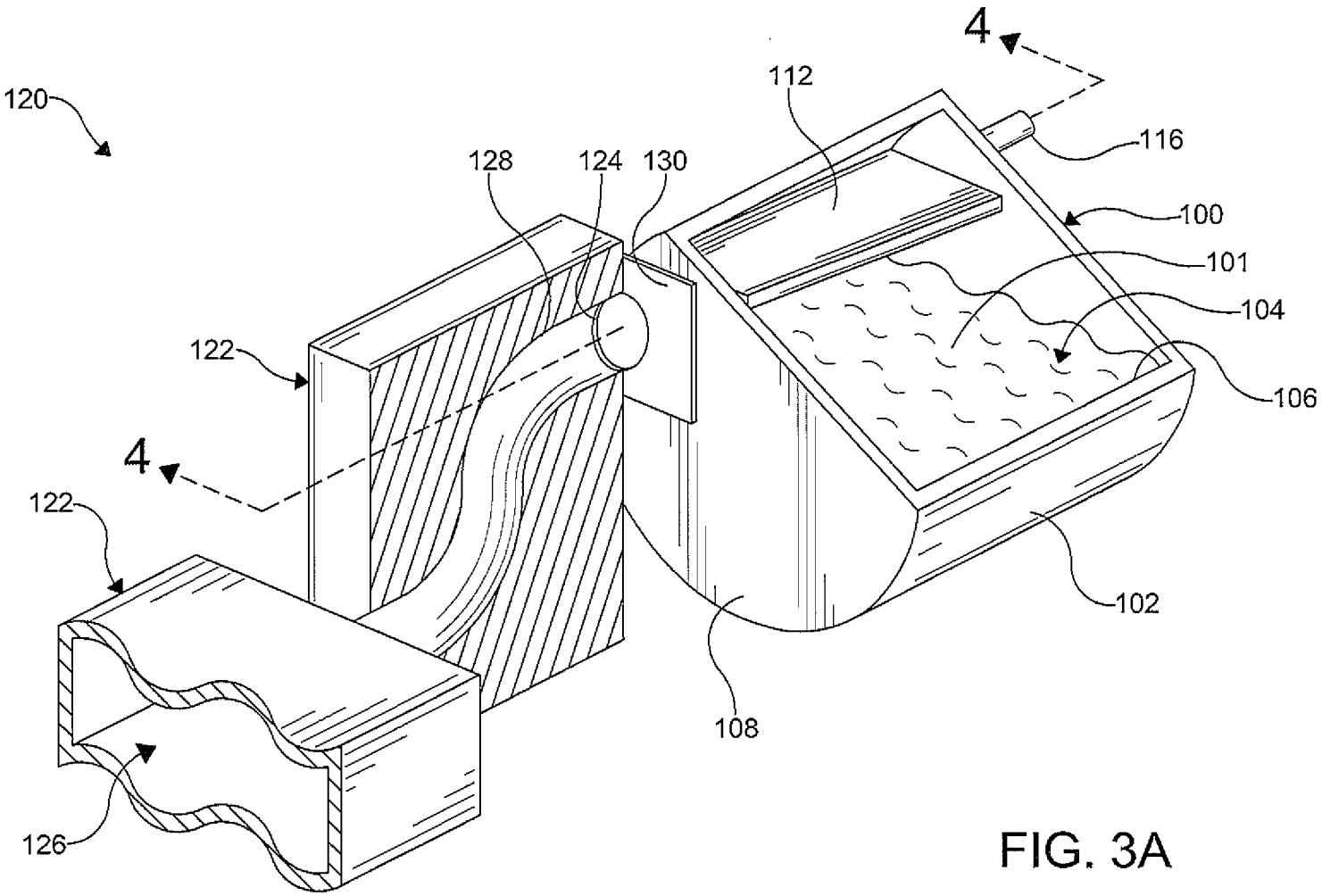
FIGS. 3A-3B are perspective views of the ladle shown in FIG. 1, the ladle cooperating with a fragmentary mold shown in cross-section to illustrate a filling of the mold.
Figure 3B:
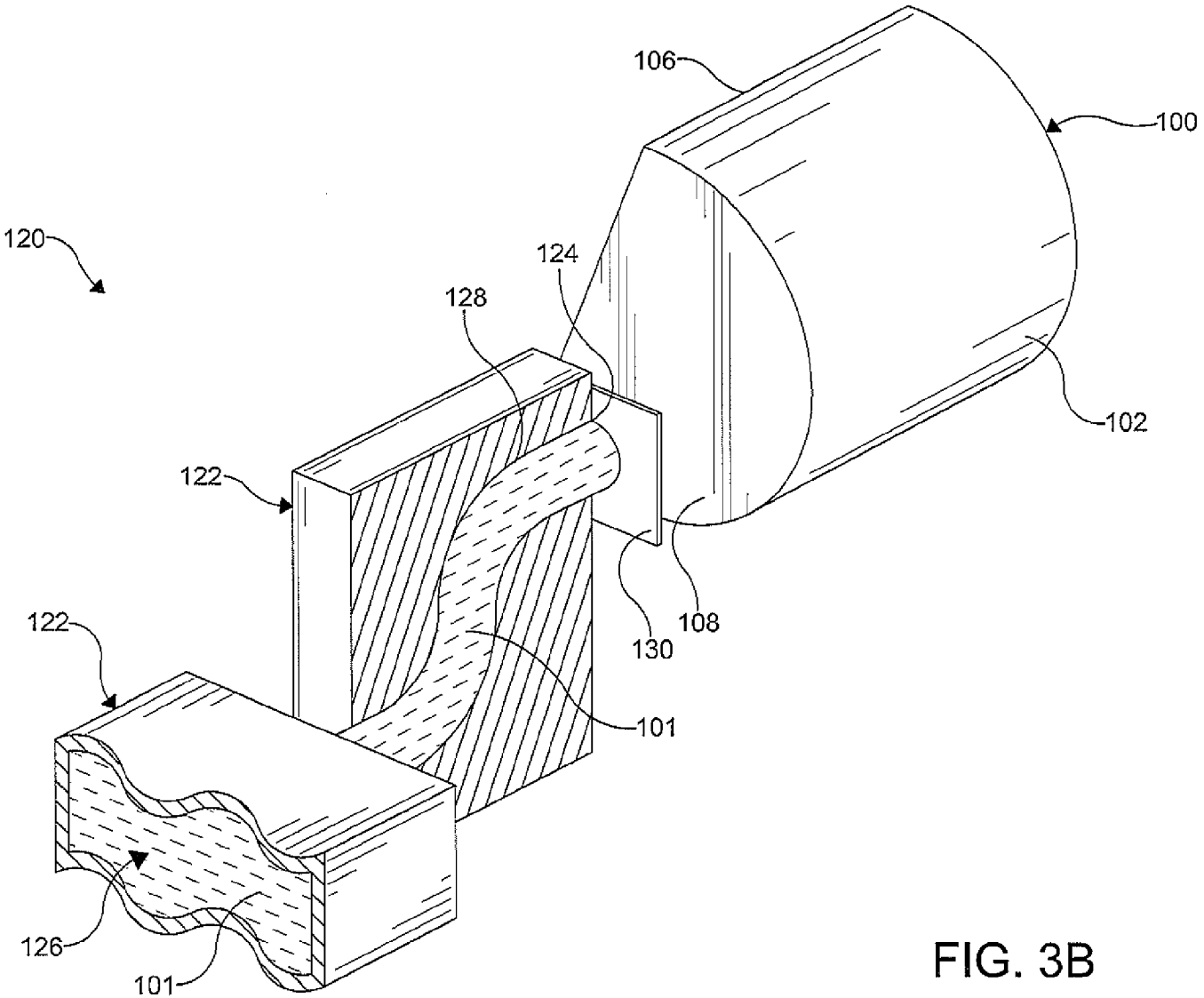

Referring now to FIGS. 3A-3B, a casting apparatus 120 of the present disclosure is shown. The casting apparatus 120 includes the ladle 100 placed in sealing contact with a casting mold 122. The mold 122 is stationary, in contrast to the ladle 100 that is movable from the dip well 118 to the mold 122. The mold 122 may be a semi-permanent type mold, although other types of casting molds may also be used within the scope of the present disclosure.

The casting mold 122 has an inlet 124 and a cavity 126 formed therein for receiving the molten metal 101. The inlet 124 is in fluid communication with the cavity 126 via a mold sprue 128, for example. The inlet 124 may be an open end of the mold sprue 128. The nozzle 110 of the ladle 100 is in fluid communication with the inlet 124 of the casting mold 122. The ladle 100 is rotatable about the axis of rotation A to deliver the molten metal 101 from the nozzle 110 of the ladle 100 into the cavity 126 of the mold 122 when the ladle 100 is rotated from the first position (shown in FIG. 3A) to the second position (shown in FIG. 3B).

Figure 4:
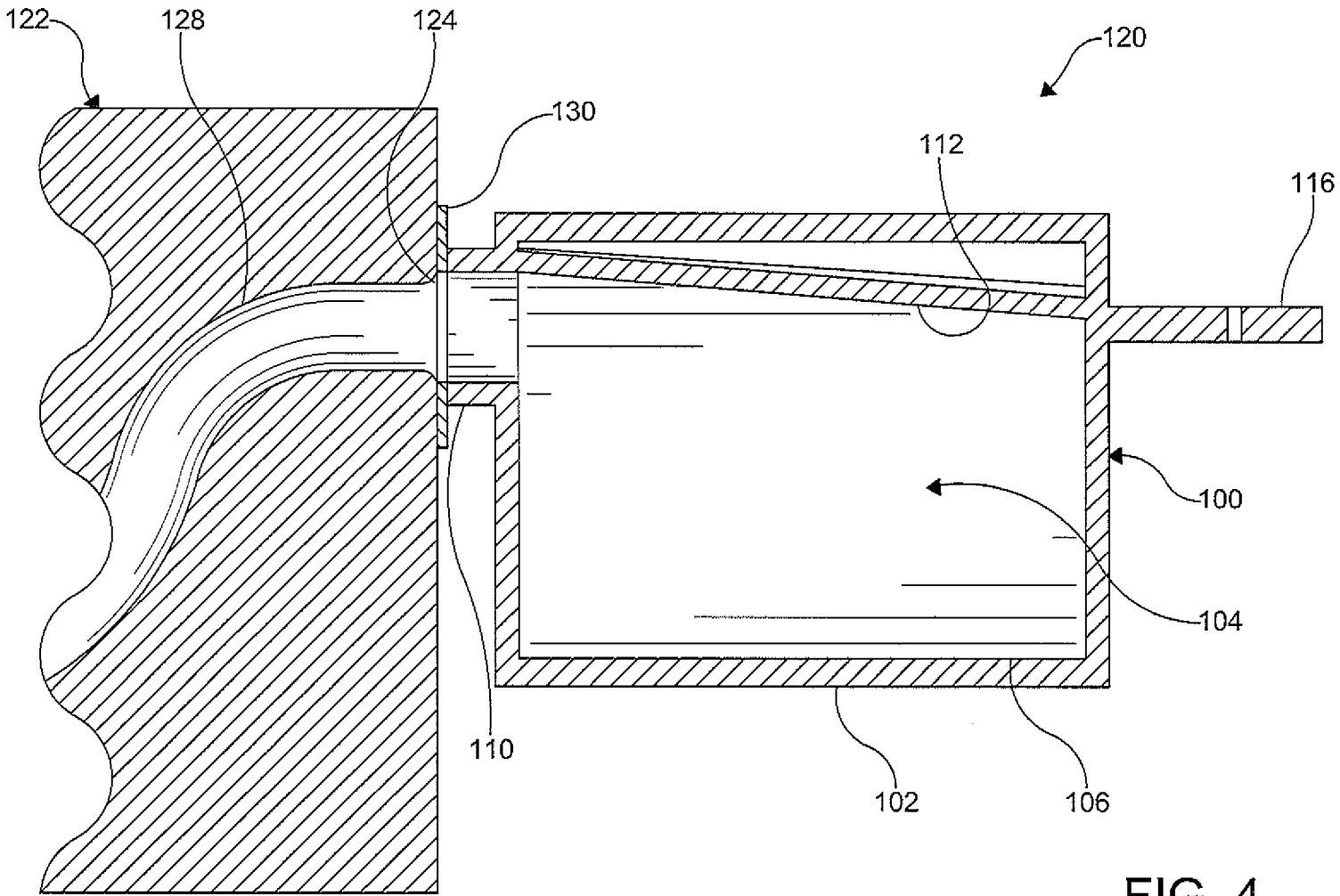
FIG. 4 is a cross-sectional fragmentary side elevational view of the ladle and mold taken along section line 4-4 in FIG. 3A, and further illustrating a gasket between a nozzle of the ladle and the mold to seal the nozzle to the mold according to an embodiment of the disclosure.

In certain embodiments, such as shown in FIGS. 3A-3B and 4, the casting apparatus 120 may include a gasket 130 disposed between the nozzle 110 and the mold 122. The gasket 130 facilitates a flat seal at an interface between the nozzle 110 and the mold 122. The gasket 130 also permits the ladle 100 to rotate about the axis of rotation A while maintaining the seal between the nozzle 110 and the mold 122. The gasket 130 may be formed from a compliant composite including fibers and graphite, for example. Other suitable temperature-stable materials may also be employed, as desired.

Figure 5:
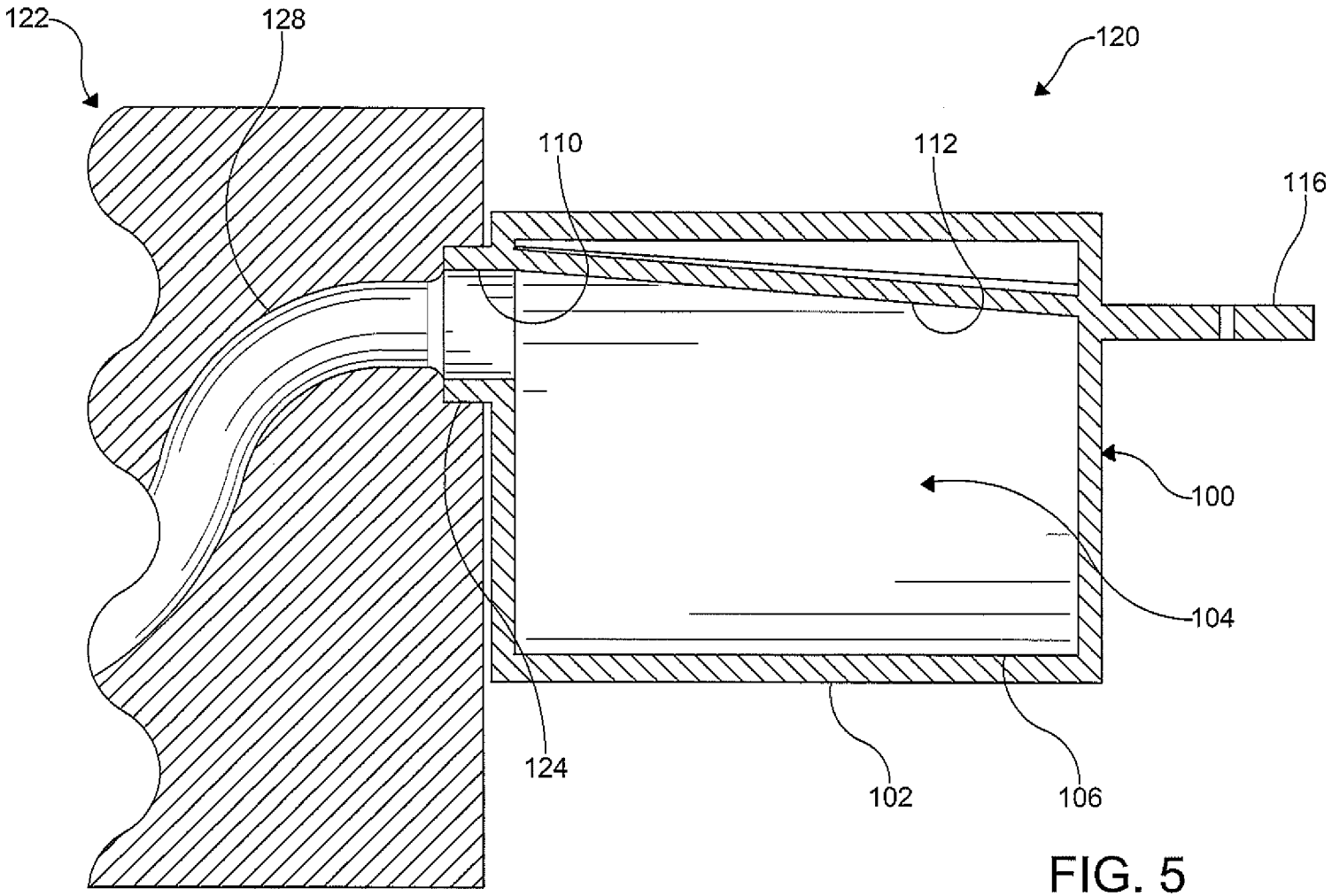
FIG. 5 is a cross-sectional fragmentary side elevational view of the ladle and mold shown in FIGS. 3A-3B, and further illustrating a cooperation of a nozzle of the ladle and the mold to seal the nozzle to the mold according to another embodiment of the disclosure.

In other embodiments, such as shown in FIG. 5, the nozzle 110 of the ladle 100 sealingly abuts the mold 122. As a nonlimiting example, the nozzle 110 may be substantially cylindrical and extend outwardly from the sidewall 108. The nozzle 110 may further be rotatably received by the inlet 124 of the mold 122. As shown in FIG. 5, the nozzle 110 may represent a male feature and the inlet 124 may represent a female feature for cooperation with the male feature. It should be understood that the nozzle 110 may alternatively be provided as a female feature with the inlet 124 provided as a male feature for cooperation with the female feature, within the scope of the present disclosure.

The present disclosure further includes a method for transferring the molten metal 101 to the casting mold 122. The method includes providing the ladle 100 and the mold 122 as described hereinabove and shown in the drawings. The ladle 100 is first filled with the molten metal 101, for example, as shown in FIGS. 2A-2B. The nozzle 110 of the ladle 100 is then placed in fluid communication with the inlet 124 of the mold 122. Prior to placing the ladle 100 in fluid communication with the inlet 124 of the mold 122, the ladle 100 is rotated to the first position. The ladle 100 may be rotated to the first position as part of the filling operation shown in FIGS. 2A-2B, for example. After the ladle 100 is placed in fluid communication with the inlet 124 of the mold 122, the ladle 100 is rotated or otherwise pivoted from the first position to the second position. The rotation from the first position to the second position raises the main body 102 of the ladle above the nozzle 110 and causes the molten metal 101 to flow out of the ladle 100 through the nozzle 110. The molten metal 101 is thereby delivered from the ladle 100, through the nozzle 110, to the cavity 126 of the mold 122.

Where the gasket 130 is employed in the casting apparatus 120, for example, as shown in FIG. 4, the step of placing the nozzle 110 of the ladle 100 in fluid communication with the inlet 124 of the mold 122 may first include a step of aligning the nozzle 110 with the inlet 124 to seal the nozzle 110 to the mold 122. The gasket 130 may then be disposed between the nozzle 110 and the mold 122 to create the fiat seal between the ladle 100 and the mold 122. In particular embodiments, the gasket 130 may be affixed to one of the ladle 100 and the mold 122 prior to aligning and placing the ladle 100 in sealing contact with the mold 122.

Where male and female cooperation is employed in the casting apparatus 120, for example, as shown in FIG. 5, the step of placing the ladle 100 in fluid communication with the inlet 124 of the mold 122 may include a step of inserting the nozzle 110 into the inlet 124 of the mold 122 to seal the nozzle 110 to the mold 122. It should be appreciated that the ladle 100 remains rotatable about the axis of rotation A when the nozzle 110 is inserted into the inlet 124 of the mold 122.

Figure 6:
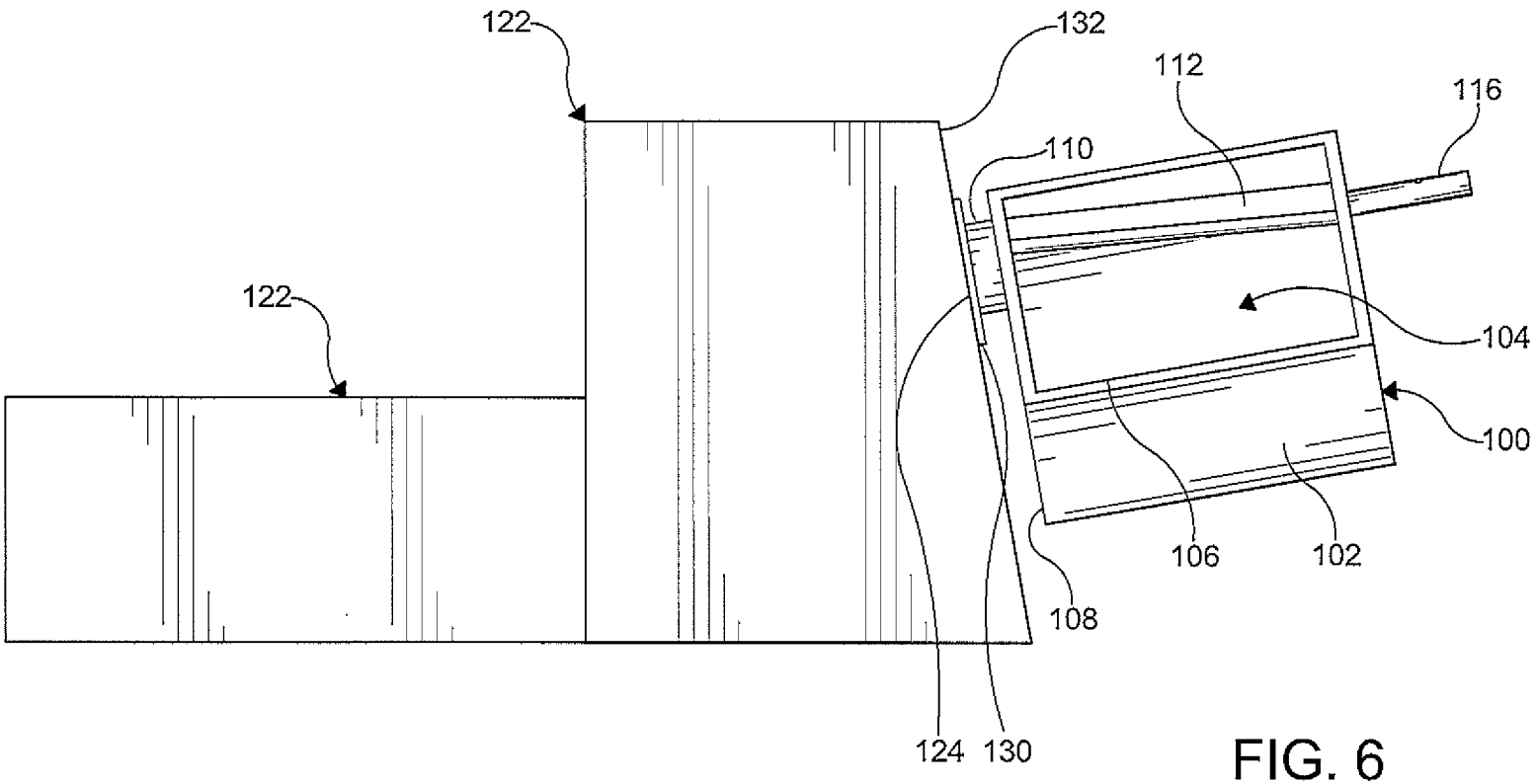
FIG. 6 is a side elevational view of the ladle shown in FIG. 1, the ladle cooperating with a mold according to a further embodiment of the disclosure.

Referring now to FIG. 6, one of ordinary skill in the art should appreciate that the ladle 100 may be tilted at an angle relative to a floor surface. The tilting of the ladle 100 facilitates delivery and removal of the molten metal 101 from the ladle 100. Where the ladle 100 is tilted at the angle relative to the floor surface, a facing surface 132 of the mold 122, within which the inlet 124 of the stationary mold 122 is formed, may also be angled to permit the sealing of the nozzle 110 with the mold 122 prior to the casting operation. As a nonlimiting example, the facing surface 132 of the mold 122 may have an angle of approximately ten degrees (10°) relative to vertical, and permit the tilting of the nozzle 110 approximately ten degrees (10°). Other tilt angles and corresponding angles for the facing surface 132 of the mold 122 may also be used within the scope of the present disclosure.

Advantageously, the casting apparatus 120 and method of the present disclosure delivers superior metal quality than a conventional tilt-pour process, with an efficiency of a gravity pour process. The contact between the ladle 100 and the mold 122 specifically minimizes turbulence of the molten metal 101, which would otherwise be poured through the air with high turbulence into a pour basin. The casting apparatus 120 and method has also been shown to minimize initial metal stream surface area and oxide film formation. Reduced subsurface porosity and leaker casting scrap is likewise provided by the casting apparatus 120 and method, due to the minimization of the turbulence to the molten metal 101 during the filling of the mold cavity 124. The funnel panel 112 and angled rear wall 114 of the ladle 100 also contribute to an efficiency of the ladle 100 by urging the molten metal 101 toward the nozzle 110 for delivery to the mold 122.

While certain representative embodiments and details have been shown for purposes of illustrating the invention, it will be apparent to those skilled in the art that various changes may be made without departing from the scope of the invention, which is further described in the following appended claims.

What is claimed is:

1. A method of transferring molten metal to a mold, the method comprising:

providing a ladle for a molten metal, the ladle including a main body having a hollow interior and an opening for receiving the molten metal, the main body having a sidewall with a nozzle formed therein, the nozzle defining an axis of rotation for the main body and configured to deliver the molten metal when the main body is rotated from a first position to a second position, the axis of rotation lying parallel to the direction that the molten metal is delivered through the nozzle;

providing a mold having an inlet and a cavity formed therein for receiving the molten metal, the nozzle of the ladle in fluid communication with the inlet, the ladle rotatable about the axis of rotation to deliver the molten metal from the nozzle of the ladle into the cavity of the mold when the ladle is rotated from the first position to the second position;

filling the ladle with the molten metal;

placing the nozzle of the ladle in fluid communication with the inlet of the mold; and rotating the ladle from the first position to the second position to deliver the molten metal from the ladle into the cavity of the mold.

2. The method of claim 1, wherein the ladle is filled with the molten metal by rotating the ladle to the first position in a dip well.

3. The method of claim 1, wherein the step of placing the nozzle of the ladle in fluid communication with the inlet of the mold includes aligning the nozzle with the inlet to seal the nozzle to the mold.

4. The method of claim 3, wherein the step of placing the nozzle of the ladle in fluid communication with the inlet of the mold includes providing a gasket between the nozzle and the mold to create a flat seal between the ladle and the mold.

5. The method of claim 1, wherein the step of placing the nozzle of the ladle in fluid communication with the inlet of the mold includes inserting the nozzle into the inlet of the mold to seal the nozzle to the mold.

6. The method of claim 5, wherein the ladle is rotatable about the axis of rotation when the nozzle is inserted into the inlet of the mold.

7. The method of claim 1, wherein the nozzle in the first position is not in fluid communication with the molten metal in the hollow interior, and the nozzle in the second position is in fluid communication with the molten metal in the hollow interior.

* * * * *